United States Patent [19]

Decker

[11] Patent Number: 4,473,213

[45] Date of Patent: Sep. 25, 1984

[54] SERVICE JACK INCLUDING RACK AND PINION DRIVEN PUMP PISTON

[75] Inventor: Arnold F. Decker, Sussex, Wis.

[73] Assignee: Hein-Werner Corp., Waukesha, Wis.

[21] Appl. No.: 460,452

[22] Filed: Jan. 24, 1983

[51] Int. Cl.[3] ..... B66F 3/24

[52] U.S. Cl. ..... 254/8 B

[58] Field of Search ..... 254/93 H, 93 R, 8 B, 254/6 B; 60/482

[56] References Cited

U.S. PATENT DOCUMENTS

| | | | |
|---|---|---|---|
| 1,767,124 | 6/1930 | Flanagan | 254/93 H |
| 1,784,116 | 12/1930 | Shevlin | 254/93 H |
| 3,907,252 | 9/1975 | Gaarder | 254/8 B |

*Primary Examiner*—Robert C. Watson

[57] ABSTRACT

A service jack for use in jacking vehicles and the like and including a lift member supported by a frame for movement between a lower position and a raised load carrying position. A hydraulic lift cylinder is provided for causing selective movement of the lift member between the first position and load carrying position. A hydraulic pump is also provided for selectively forcing hydraulic fluid into the hydraulic lift cylinder to cause movement of the lift member from the first position to the second position. The hydraulic pump includes a pump cylinder, and a pump piston housed in the pump cylinder, a pinion about an axis, said pinion including gear teeth. A rack is fixed to the pump piston, the rack including gear teeth meshing with the gear teeth of a pinion supported by the frame for rotation, the pinion being rotably driven by pumping movement of the jack handle.

5 Claims, 5 Drawing Figures

SERVICE JACK INCLUDING RACK AND PINION DRIVEN PUMP PISTON

FIELD OF THE INVENTION

The present invention relates to service jacks and other hydraulic jacks of the type for use in lifting automobiles or other vehicles or for use in other similar lifting applications where a manually operable hydraulic jack can be employed.

BACKGROUND OF THE PRIOR ART

Hydraulic service jacks of the type used in lifting vehicles are well known. Such jacks commonly include a hydraulic cylinder and a hydraulic pump adapted to be manually driven so as to selectively force hydraulic fluid into the hydraulic cylinder. Examples of prior art hydraulic service jacks are set forth in the Flanagan U.S. Pat. No. 1,767,124 issued June 24, 1930; the Shevlin U.S. Pat. No. 1,784,116, issued Dec. 9, 1930; the Eason, et al. U.S. Pat. No. 1,978,451, issued Oct. 30, 1934; the Mueller U.S. Pat. No. 2,629,583, issued Feb. 24, 1953; and the Jakob U.S. Pat. No. 1,799,298, issued Apr. 7, 1931.

In some of the prior art service jacks such as those shown in the Eason U.S. Pat. No. 1,978,451 and the Mueller U.S. Pat. No. 2,629,583, the hydraulic pump is operable only when the jack handle of the service jack is in a nearly horizontal position and wherein the free end of the jack handle is close to the ground. Since the pumping action of the jack handle with the jack handle close to the ground is inconvenient to the operator, more modern service jacks have been designed with a hydraulic fluid pump arrangement specifically constructed to permit a pumping operation with the jack handle in a more vertical or raised position. The pump constructions of these jacks have the disadvantage of causing a lateral load to be placed on the piston of the hydraulic pump, thereby causing wear of the pump piston and the pump cylinder wall.

SUMMARY OF THE INVENTION

The present invention provides an improved service jack having an improved hydraulic fluid pumping mechanism which is both conveniently operated and which also has improved wear charcteristics.

More particularly, the invention includes a service jack for use in jacking vehicles and the like, the service jack including a frame and a lift member supported by the frame for movement between a first position wherein a load carrying portion of the lift member is in a lower position and a second position wherein the load carrying portion of the lift member is in a raised load carrying position. Means are also provided for causing selective movement of the lift member between the first position and the second position, the means for causing selective movement including a hydraulic lift cylinder and means for selectively forcing hydraulic fluid into the hydraulic lift cylinder to cause movement of the lift member to the second position. The means for selectively forcing hydraulic fluid into the hydraulic lift cylinder includes a pump cylinder, a pump piston housed in the pump cylinder, and means for causing reciprocation of the piston in the pump cylinder. The means for causing reciprocation includes a pinion including gear teeth, a rack fixed to the pump piston, the rack including gear teeth meshing with the gear teeth of the pinion, and means for causing selective rotation of the pinion.

The invention further includes a service jack having a hydraulic lift cylinder including a ram and means for selectively forcing hydraulic fluid into the cylinder to cause movement of the ram to a lifting position, the means for selectively forcing hydraulic fluid into the hydraulic lift cylinder including a pump cylinder, and a pump piston housed in the pump cylinder. Means are also provided for causing reciprocation of the piston in the pump cylinder including a pinion supported by the frame for rotation about an axis, the pinion including gear teeth, a rack fixedly joined to the pump piston, the rack including gear teeth meshing with the gear teeth of the pinion, and means for causing selective rotation of the pinion.

One of the principal features of the invention is the provision of the pinion being positioned on one side of the rack, and means for slidably supporting an opposite side of the rack and for compensating for lateral forces applied on the rack by the pinion and to thereby prevent wear of the pump piston and cylinder.

In a preferred embodiment of the invention, the means for slidably supporting an opposite side of the rack includes a guide member surrounding a portion of the rack, the guide member including a surface slidably supporting the opposite side of the rack, and the guide member being positioned in generally horizontal alignment with the pinion whereby lateral force on the rack by the pinion is opposed by an opposite force on the rack by the guide member.

In a preferred embodiment of the invention, the means for causing selective rotation of the pinion includes an elongated lever having opposite ends, one end being connected to the pinion such that the lever is pivotable about the axis of rotation of the pinion, and the opposite end of the lever forming a jack handle.

One of the particular advantages of the service jack embodying the invention is that by providing a rack and pinion driven hydraulic pump, the jack handle can be either in a raised or lowered position and still be functional to pump hydraulic fluid into the hydraulic cylinder.

Another of the advantages of the invention is that the hydraulic pump mechanism is constructed such that the lateral forces on the pump piston are controlled and wear of the piston is reduced. This prolongs the useful life of the hydraulic jack.

Various other features and advantages of the invention will be apparent by reference to the following description of the preferred embodiment, from the claims and from the drawings.

Figure 2:
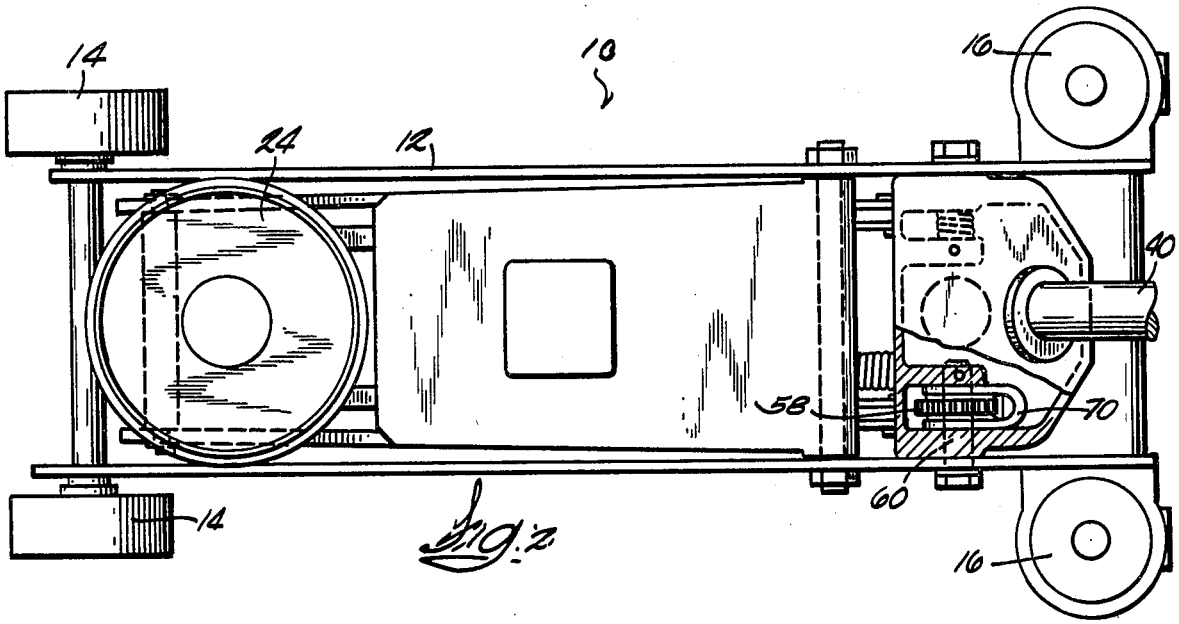
FIG. 2 is a plan view of the service jack illustrated in FIG. 1.

Before describing a preferred embodiment of the invention in detail, it is to be understood that the invention is not limited in its application to the details of construction and to the arrangement set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF A PREFERRED EMBODIMENT

Figure 1:
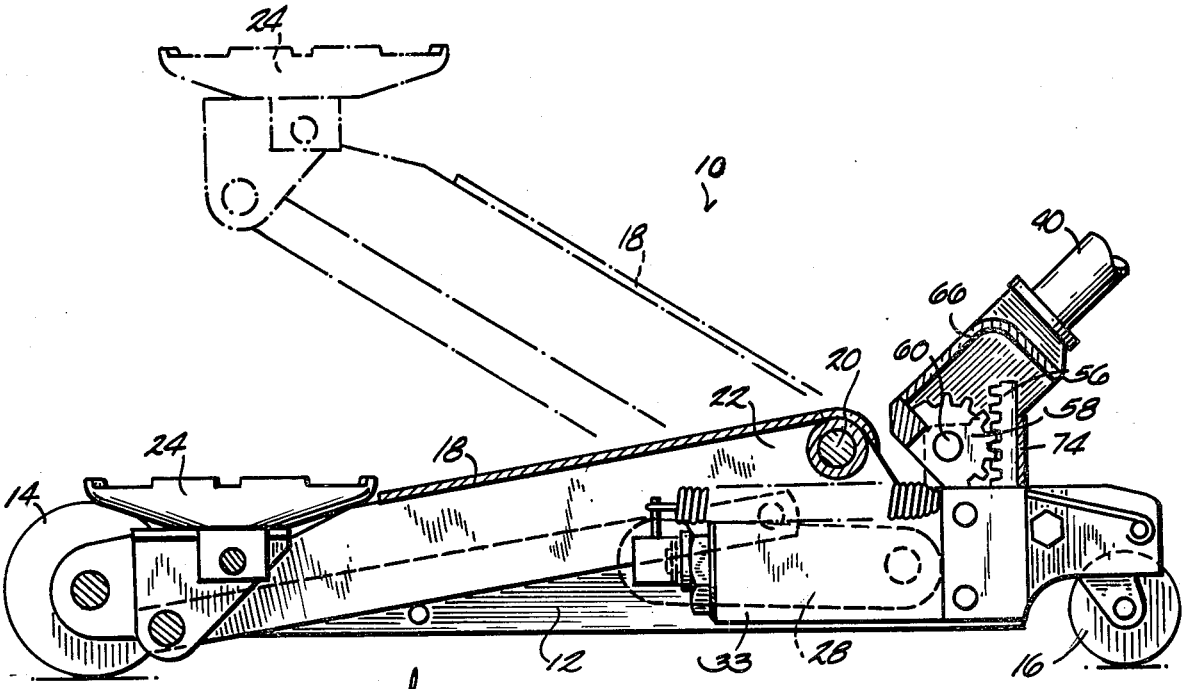
FIG. 1 is a side elevation view, partially in section, of a service jack embodying the invention.

Illustrated in FIG. 1 is a service jack 10 embodying the present invention and comprising a hydraulic jack of the type commonly used to lift automobiles or other vehicles or for other use in similar lifting applications.

The service jack 10 generally includes a frame 12 supported at its forward end by a pair of wheels 14 and at its rearward end by a pair of casters 16. The frame 12 supports a pivotable lifting member or lifting arm 18. One end 22 of the pivotable lifting arm 18 is pivotably joined to the frame 12 by a main pin 20, and the opposite end 24 of the lifting 18 arm is adapted to be positioned beneath the load to be lifted.

Means are also provided for causing movement of the lifting arm 18 such that the free end or lifting end 24 of the arm is moved from a lower position as illustrated in solid lines in FIG. 1 to a raised position illustrated in phantom. In the illustrated construction this means comprises a hydraulic cylinder assembly 28 (FIGS. 1 and 3-4) supported by the frame 12 and including a ram 30 (FIG. 4) housed in a cylinder 32. The hydraulic cylinder assembly 28 also includes a fluid reservoir sleeve 33 surrounding the cylinder 32 and defining a reservoir 35 for hydraulic fluid. The ram 30 includes a free end connected in a conventional manner to the lifting arm 18 in such a manner that extension of the ram 30 is effective to cause movement of the lifting arm 18 from a lowered position to a raised or lifting position. The construction of the hydraulic lifting cylinder assembly 28 and the lifting arm 18 are conventional and, accordingly, will not be described in detail.

Figure 4:
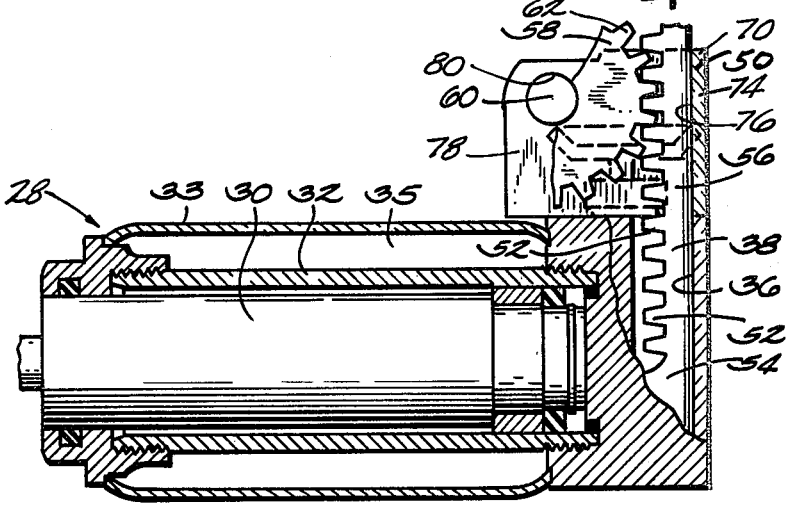
FIG. 4 is a cross section view taken along line 4—4 in FIG. 3.
Figure 5:
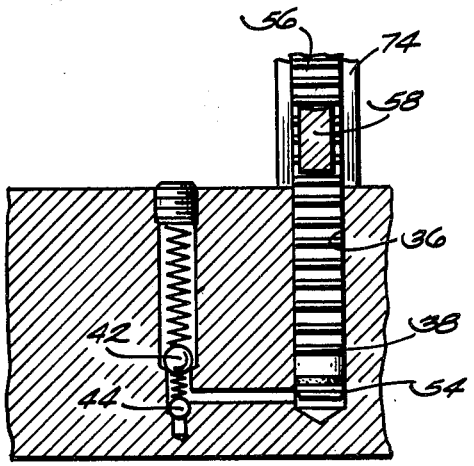
FIG. 5 is a cross section view taken along line 5—5 in FIG. 3.

Means are also provided for manually pumping hydraulic fluid into the hydraulic lifting cylinder 32 to provide for extension of the hydraulic ram 30 and consequent upward movement of the free end 24 of the lifting arm 18. This pumping means includes a hydraulic pumping cylinder 36 (FIGS. 4 and 5) housing a pumping piston 38 (FIG. 5). While the hydraulic cylinder 36 could have various orientations, in the illustrated arrangement, it is positioned such that its longitudinal axis is vertical.

The hydraulic pump piston 38 is intended to be caused to be reciprocated in the pump cylinder 36 by operation of an elongated jack handle 40 in a manner to be described more particularly hereinafter. A first check valve 42 is disposed between the hydraulic cylinder 32 and the pump cylinder 36, and a second valve 44 is disposed between the pump cylinder 36 and the hydraulic fluid reservoir 35. In operation of the hydraulic pump, upward movement of the hydraulic piston 38 causes fluid flow from the hydraulic fluid reservoir 35 past the check valve 44 and into the pump cylinder 36. Downward movement of the pump piston 38 will then cause hydraulic fluid to be forced past the check valve 42 into the hydraulic cylinder 32.

Means are also provided for causing reciprocation of the pump piston 38 in response to pumping movement of the jack handle 40, this means including a rack and pinion assembly. In the illustrated construction the upper end of the pump piston 38 includes a plurality of gear teeth 52 arranged so as to form a rack. In the illustrated arrangement, the pump piston 38 comprises an elongated member and with one end of that elongated member comprising the piston head 54 and with the opposite end 56 of the pump piston being machined in such a manner as to form a plurality of linearly aligned spaced apart gear teeth 52, these gear teeth forming the rack. The rack and pinion assembly 50 also includes a pinion 58 supported for rotation by a shaft or handle fork pin 60, in turn, supported by the frame, the handle fork pin 60 being oriented such that it has a horizontal axis perpendicular to the vertical axis of the pump piston 38. The pinion 58 includes gear teeth 62 adapted to mesh with the gear teeth 52 of the rack.

While the pump piston 38 and the rack are illustrated as having a one-piece or integrally joined construction, it should be understood that in other arrangements the rack and the pump piston could be separate elements fixedly joined together.

The lower end of the jack handle or lever 40 is connected to a handle fork 66 pivotably joined to the frame 12 and supported for rotation with the pinion 58 such that pivotal or pumping movement of the pinion 58 results in reciprocation of the rack and the pump piston 38.

Means are also provided for supporting the rack and the pump piston 38 so as to resist lateral forces placed on the rack and the pump piston 38 by the pinion 58. This means for supporting the rack and pump piston 38 includes a sleeve or guide member 70 surrounding at least that portion of the rack and pump piston 38 which is in mechanical engagement with the pinion 58, the guide being positioned on an opposite side of the rack 38 from the pinion 58. The guide 70 is adapted to provide a lateral force on the rack equal to and opposite to any lateral or nonvertical forces applied on the rack by the pinion 58. The guide 70 thus prevents binding or misalignment of the pump piston 38 and the cylinder 36 or any other wear of the pump piston 38 with respect to the cylinder 36 and prolongs the wear life of the piston and the cylinder.

Figure 3:
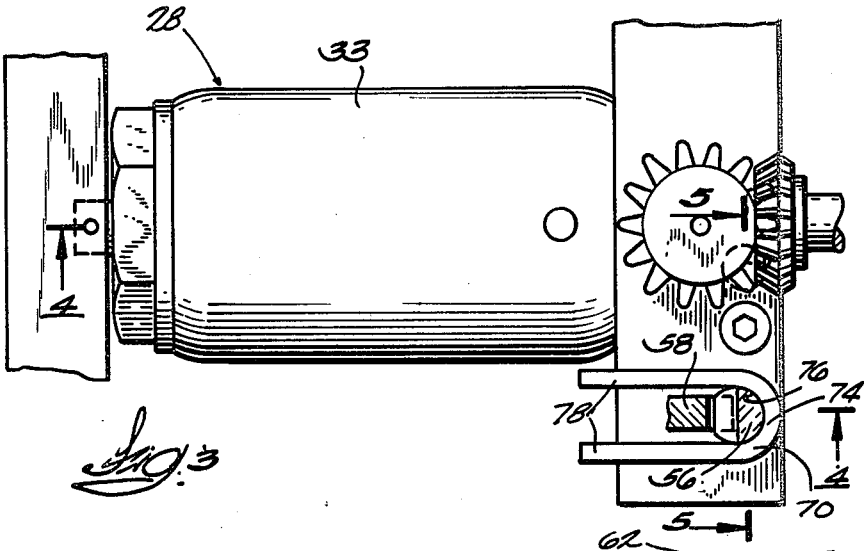
FIG. 3 is an enlarged partial plan view of the apparatus illustrated in FIGS. 1 and 2.

Referring more particularly to the configuration of the guide 70 supporting the rack, the guide 70 comprises a U-shaped member when viewed in plan as in FIG. 3 and including a bight portion 74 having a semicylindrical interior surface 76 adapted to slidably house the upper portion of the rack 38, the surface 76 being a smooth vertical surface adapted to slidably support that portion of the rack 38 adjacent the pinion. This surface 76 of the guide 70 is vertically aligned with a portion of the surface of the cylinder 36 such that the surface 76 is substantially continuous with the bore of the pump cylinder 36. The guide 70 also includes a pair of legs 78 including aligned bores 80 adapted to house the handle yoke pin 60 such that the guide 70 is supported by the handle yoke pin. It will be noted that the legs 78 of the guide 70 thus function ensure a proper spaced relation between the axis of the pinion 58 and the pump piston 38.

Means are also provided for selectively venting the hydraulic cylinder 32. This means includes a means for venting the cylinder 32 in response to rotation of the jack handle 40, the rotation of the jack handle 40 being operably connected to the means for venting through a pinion gear assembly illustrated in FIG. 3. Since this means for venting the lifting cylinder 32 is conventional, it will not be explained in detail.

Various other features of the invention are set forth in the following claims:

I claim:

1. A service jack for use in jacking vehicles and the like, said service jack comprising a frame, a lift member pivotably supported by said frame for movement between a first position wherein a load carrying portion of said lift member is in a lower position and a second position wherein said load carrying portion of said lift member is in a raised load carrying position, means for causing selective movement of said lift member between said first position and said second position, said means for causing selective movement including a hydraulic lift cylinder and means for selectively forcing hydraulic fluid into said hydraulic lift cylinder to cause movement of said lift member from said first position to said second position, said means for selectively forcing hydraulic fluid into said hydraulic lift cylinder including a pump cylinder, a pump piston housed in said pump cylinder, and means for causing reciprocation of said piston in said pump cylinder, said means for causing reciprocation including a pinion supported by a shaft for rotation about an axis, said pinion including gear teeth, a rack connected to said pump piston and for causing movement of the pump piston in the pump cylinder, said rack including gear teeth meshing with said gear teeth of said pinion, and said pinion being positioned on one side of said rack, means for slidably supporting an opposite side of said rack, said means for slidably supporting an opposite side of said rack including a guide member, said guide member including a rack supporting portion having a surface slidably supporting said opposite side of said rack, and said guide member including a pair of legs projecting from said rack supporting portion of said guide member, said legs being positioned on opposite sides of said pinion, and said legs including bores housing the shaft supporting the pinion, and wherein said guide member is positioned such that lateral force on said rack by said pinion is opposed by an opposite force on said rack by said rack supporting portion of said guide member, and means for causing selective rotation of said pinion.

2. A service jack as set forth in claim 1 wherein the guide member surface slidably supporting the opposite side of the rack is aligned with the surface of the pump cylinder.

3. A service jack as set forth in claim 1 wherein the means for causing selective rotation of the pinion includes a jack handle having opposite ends, means for pivotally connecting the jack handle to the frame for pivotable movement about a horizontal axis, the means for pivotally connecting including a yoke fixed to one of said ends of the jack handle, and wherein said shaft supporting said pinion pivotally connects the yoke to the frame.

4. A service jack as set forth in claim 3 wherein said yoke includes opposite sides, said shaft supporting said pinion pivotally connecting one of said opposite sides to the frame and a second shaft pivotally connecting the other of said opposite sides to the frame.

5. A service jack for use in jacking vehicles and the like, said service jack comprising:

a frame, a lift member supported by the frame for movement between a first position wherein a load carrying portion of the lift member is in a lower position and a second position wherein said load carrying portion of the lift member is in a raised load carrying position, means for causing selective movement of the lift member between said first position and said second position, the means for causing selective movement including a hydraulic lift cylinder and means for selectively forcing hydraulic fluid into the hydraulic lift cylinder to cause movement of the lift member from said first position to said second position, said means for selectively forcing hydraulic fluid into said hydraulic lift cylinder including, a pump cylinder a pump piston housed in the pump cylinder, and means for causing reciprocation of said piston in said pump cylinder, said means for causing reciprocation including a pinion supported for rotation about an axis, said pinion including gear teeth, a rack fixed to the pump piston, said rack including gear teeth meshing with said gear teeth of said pinion, and means for causing selective rotation of the pinion, the means for causing selective rotation including a jack handle having opposite ends, means for pivotally connecting the jack handle to the frame for pivotable movement, the means for pivotally connecting including a yoke fixed to said end of the handle, and a pivot shaft having a central longitudinal axis and pivotally connecting the yoke to the frame, the yoke being fixed to said shaft whereby movement of the handle causes pivotal movement of the shaft about the central longitudinal axis of the shaft, and the pinion being fixed to the shaft whereby pivotal movement of the shaft causes pivotal movement of the pinion.

* * * * *